US006415861B1

(12) United States Patent
Harrison, Jr. et al.

(10) Patent No.: US 6,415,861 B1
(45) Date of Patent: Jul. 9, 2002

(54) WELLHEAD FLUID COLLECTION SYSTEM

(76) Inventors: Clyde Harrison, Jr., 900 E. Sanger; Clinton P. Taylor, 2908 W. Marland, both of Hobbs, NM (US) 88240

( * ) Notice: Subject to any disclaimer, the term of this patent is extended or adjusted under 35 U.S.C. 154(b) by 0 days.

(21) Appl. No.: 09/315,676

(22) Filed: May 20, 1999

Related U.S. Application Data

(60) Provisional application No. 60/090,058, filed on Jun. 19, 1998.

(51) Int. Cl.[7] ..... F21B 43/00
(52) U.S. Cl. ..... 166/81.1; 175/66; 175/206
(58) Field of Search ..... 166/81.1; 285/13; 175/206, 66

(56) References Cited

U.S. PATENT DOCUMENTS 4,269,569 A * 5/1981 Hoover
4,949,784 A * 8/1990 Evans ..... 166/81.1
5,121,794 A * 6/1992 Hibdon et al. ..... 166/81.1
5,167,277 A * 12/1992 Evans ..... 166/81.1
5,228,506 A * 7/1993 Pearce ..... 166/81.1
5,343,943 A * 9/1994 Norris et al. ..... 166/81.1
5,351,753 A * 10/1994 Golson ..... 166/81.1
5,377,748 A * 1/1995 Gayaut ..... 166/81.1
5,419,400 A * 5/1995 Wigington ..... 166/379
5,634,485 A * 6/1997 Holtby ..... 137/15
5,857,518 A * 1/1999 Vinson ..... 166/81.1

* cited by examiner

*Primary Examiner*—David Bagnell
*Assistant Examiner*—Jennifer R. Dougherty
(74) *Attorney, Agent, or Firm*—Kilpatrick Stockton LLP

(57) ABSTRACT

A fluid collection system for connection upon a wellhead. The collection system includes a fluid collection pan having an upwardly open fluid reservoir. The pan is adapted to be connected in-line with a wellhead conduit. The pan has an upwardly convex floor adapted to direct collected fluids in the reservoir toward a peripheral trough that is formed between the floor and a surrounding side wall to the floor. One or more drains is positioned at the trough for accommodating withdrawal of collected fluid therefrom. A wellhead extension conduit is included that has a through bore configured for conveying well produced fluids from below the fluid collection pan to above the fluid reservoir. Preferably, the extension conduit and the pan are unitarily configured to permit on-site monolithic installation of the assembly upon a wellhead.

19 Claims, 2 Drawing Sheets

WELLHEAD FLUID COLLECTION SYSTEM

RELATED PATENT APPLICATIONS

This patent application claims priority to U.S. Provisional Application No. 60/090058 filed on Jun. 19, 1998, entitled WELLHEAD FLUID CONTAINMENT SYSTEM, said application in its entirety is hereby expressly incorporated by reference into the present application.

DESCRIPTION

1. Technical Field

The present invention relates to well servicing devices and systems, and particularly to devices and systems used in servicing petroleum and gas producing wells.

2. Background Art

Often during oil well servicing, fluids spill from the wellhead. Early containment practice of such spills consisted of digging a pit around the wellhead. Environmental and regulatory concerns effectively discouraged such practice, leading to the need for alternate means to contain liquid spilled during well servicing. To date, devices and methods used to contain excess fluid spilled from a wellhead during servicing have suffered from several drawbacks. For example, among other things, such devices and methods generally: 1) obstruct the area around the wellhead thereby interfering with servicing; 2) include pans that require assembly at the well site or are cumbersome to install; 3) include pans that are constructed of separate pieces thereby being subject to leaks; and 4) where pumping means are used to transfer contained liquids away from the wellhead, such means involve electrical or internal combustion drives which, for safety reasons, must be located some distance away from the wellhead.

In view of the above described deficiencies associated with the use of known wellhead systems, the present invention has been developed to alleviate these drawbacks and provide further benefits to the user. These enhancements and benefits are described in greater detail herein below with respect to several alternative embodiments of the present invention.

DISCLOSURE OF THE INVENTION

The present invention in its several disclosed embodiments alleviates the drawbacks described above with respect to conventionally designed wellhead servicing devices and incorporates several additionally beneficial features.

In at least one embodiment, the present invention takes the form of a fluid collection system for connection aboveground upon a wellhead. The fluid collection system includes a fluid collection pan assembly defining an open fluid reservoir in an upper portion thereof, the pan assembly being connectable upon a wellhead so that produced fluids pass through and above the pan assembly for collection in the reservoir. A fluid withdrawal pump is connected in fluid communication with the reservoir and the fluid withdrawal pump is adapted to be hydraulically powered by a main hydraulic system of a well servicing rig already on site thereby avoiding the need for a supplementary hydraulic power source at the well site.

In a further embodiment, the invention takes the form of a fluid collection system for connection upon a wellhead. The collection system includes a fluid collection pan having an upwardly open fluid reservoir. The pan is adapted to be connected in-line with a wellhead conduit. The pan has an upwardly convex floor adapted to direct collected fluids in the reservoir toward a peripheral trough that is formed between the floor and a surrounding side wall to the floor. One or more drains is positioned at the trough for accommodating withdrawal of collected fluid therefrom. A wellhead extension conduit is included that has a through bore configured for conveying well produced fluids from below the fluid collection pan to above the fluid reservoir. Preferably, the extension conduit and the pan are unitarily configured to permit on-site monolithic installation of the assembly upon a wellhead.

The present invention mitigates obstruction of the wellhead. In addition to providing a wide pan that will capture fluids spilled from the wellhead during servicing, the present invention also includes a through hole in the pan for accommodating tool assemblies inserted in the servicing string. Further, the pan has a convex interior with two drain outlets placed at the pan's outside edges, minimizing the obstruction from drain hosing.

As the pan is unitary in construction, it requires no assembly and is less susceptible to leaks than pans which require assembly. On its exterior perimeter, the pan is fitted with "D" flanges or eyes for facilitating its installation on the wellhead casing top. Support braces are also incorporated into the design of the pan for strengthening it, as well as providing an additional means for securing links used in placing the pan on the casing top.

The present invention's pump for pulling fluids from the pan to the trailer tank is driven hydraulically and controlled pneumatically, allowing the entire system to be located inside the servicing unit's safety perimeter. The pump's hydraulic motor is driven by the well servicing unit's hydraulic pump, which, in turn, is driven by the servicing unit's own power take off ("PTO") instead of an independent internal combustion motor or electrical source.

A single air valve controls the operation of the pan pump. Air for the valve comes from the servicing unit. The valve is able to be mounted near the well servicing unit's operator, thereby enabling him to operate the collection system pump at will. The advantage to this type of hydraulic/pneumatic system is that it removes a potential fire hazard and permits the collection system to be closer to the servicing unit. With an independent internal combustion motor or electrically sourced pump, the servicing unit must be at least outside the servicing unit's guy wires for fire safety reasons.

The beneficial effects described above apply generally to each of the exemplary devices and mechanisms disclosed herein of the wellhead system. The specific structures through which these benefits are delivered will be described in detail hereinbelow.

BRIEF DESCRIPTION OF THE DRAWINGS

The invention will now be described in greater detail in the following way of example only and with reference to the attached drawings, in which.

MODE(S) FOR CARRYING OUT THE INVENTION

Figure 1:
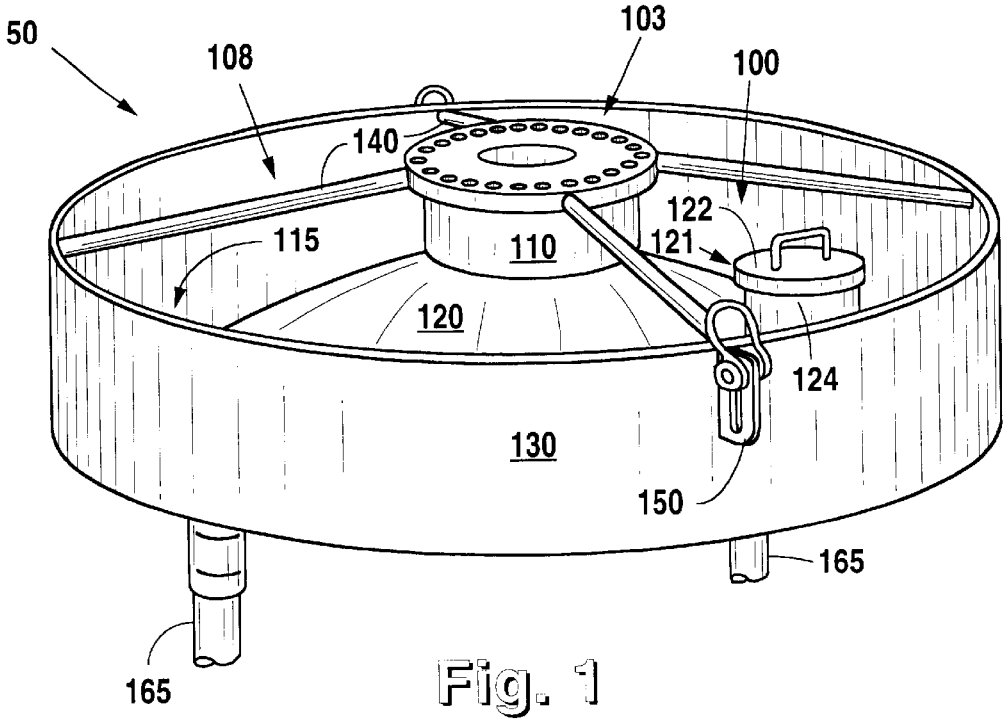
FIG. 1 is a perspective view looking downward upon the fluid collection pan assembly.
Figure 2:
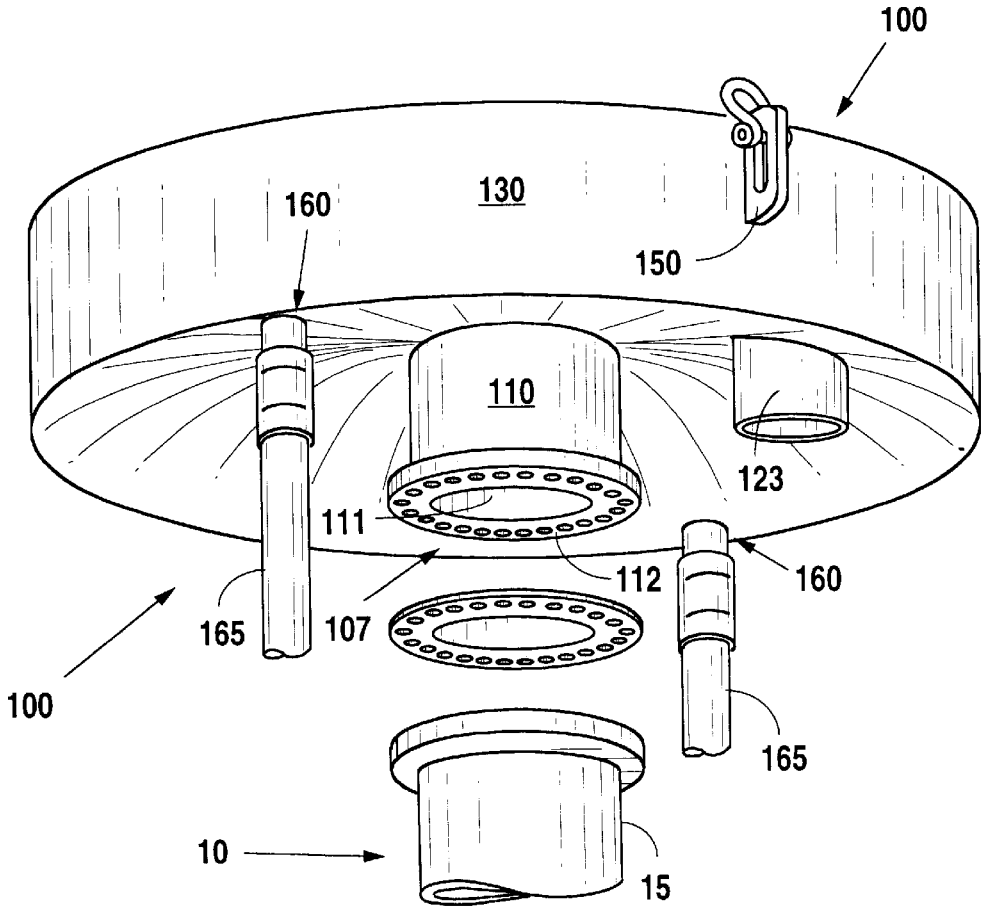
FIG. 2 is a perspective view looking upward toward the fluid collection pan assembly.
Figure 3:
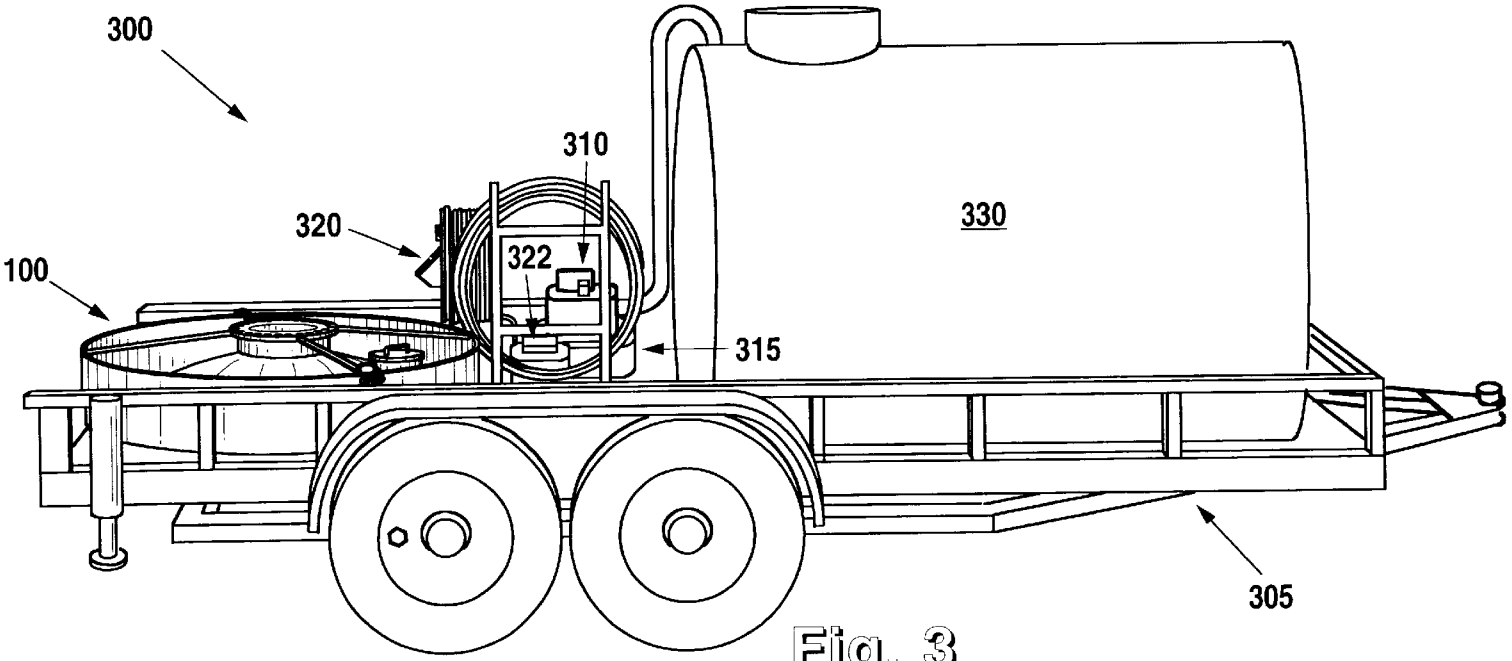
FIG. 3 is a perspective view of the fluid collection system in a trailered configuration.
Figure 4:
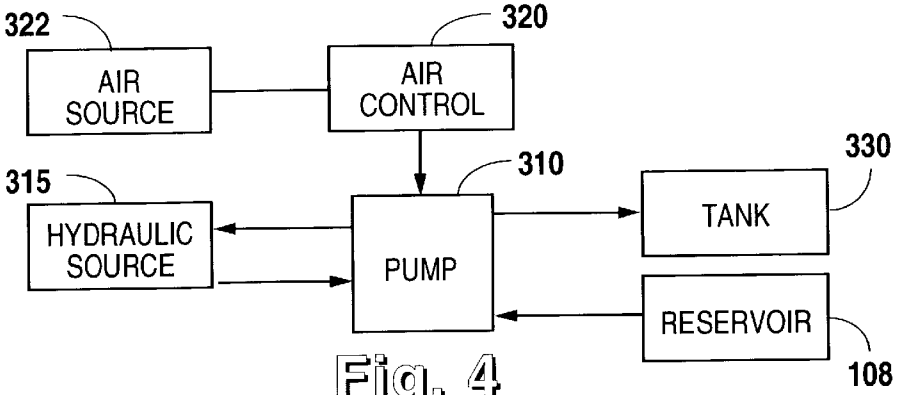
FIG. 4 is a schematic view of the function and control system of the fluid pump.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Furthermore, elements may be recited as being "coupled"; this terminology's use contemplates elements being connected together in such a way that there may be other components interstitially located between the specified elements, and that the elements so specified may be connected in fixed or movable relation one to the other.

Referring to the figures, the present invention takes the form of a fluid collection system 50 for connection upon a wellhead 10. The fluid collection system 50 includes a fluid collection pan 100 having an upwardly open fluid reservoir 108. The pan 100 is adapted to be connected in-line with a wellhead conduit 15. The pan 100 has an upwardly convex floor 120 adapted to direct collected fluids in the reservoir 108 toward a peripheral trough 115 that is formed between the floor 120 and a surrounding side wall 130 to the floor 120. One or more drains is positioned at the trough 115 for accommodating withdrawal of collected fluid therefrom. A wellhead extension conduit 110 is included that has a through bore 111 configured for conveying well produced fluids from below the fluid collection pan 100 to above the fluid reservoir 108. Preferably, the extension conduit 110 and the pan 100 are unitarily configured and constructed to permit on-site monolithic installation of the assembly 15 upon a wellhead 10.

Drainage conduit 165 is fluidly connected to each drain 160 and each drainage conduit 165 is arranged so that it is positioned at a clearance distance from the wellhead 10 upon which the fluid collection system 50 is to be installed. A withdrawal pump 310 is fluidly connected to the drainage conduit 165 and is adapted to be hydraulicly driven by a main hydraulic system of a truck-style well servicing rig or unit that is already on site thereby avoiding the need for a supplementary hydraulic power source at the well site. An air control 320 for actuating the withdrawal pump 310 is provided that is adapted to be powered by a pressured air source 322 of the well servicing rig or unit similarly avoiding the need for a supplementary pressured air source 322 at the well site.

A carrying vehicle 300 is adapted to transport the fluid collection system 50 between well sites. A fluid collection tank 330 is mounted upon the carrying vehicle 300 and is adapted to receive withdrawn fluid from the drainage conduit 165.

The wellhead extension conduit 110 has two end portions, each end portion terminating in a connective flange 112 adapted for sealed mating engagement with a wellhead conduit 15. Brace members 140 are connected between the side wall 130 peripherally located about the floor 120 and the wellhead extension conduit 110 for rigidifying the pan assembly 100. Open loop receivers 150 are included on the pan assembly 100 that are adapted for connection to a suspension system used in installation and removal of the pan assembly 100 on to off of the wellhead conduit 15.

An access port 121 that extends through the floor 120 of the pan assembly 100 is included that is configured to permit well tools to be passed therethrough between above-pan 103 and below-pan 107 positions. An upstanding tubular wall 123 extends upwardly from the floor 120 at a periphery of the access port 121 and is provided and configured to prevent collected produced well fluids from draining from the reservoir 108 through the access port 121. A closure 122 is included for capping a top portion 124 of the tubular wall 123 during times of non-use of the access port 121.

Supplementary embodiments may be characterized according to the following descriptions in which a wellhead fluid collection system comprises a pan 100 for containing liquid spilled from the wellhead 10 and drainage conduit 165 for transferring the liquid to a trailer assembly 300. The pan 100 is of unitary structure having several features which enable the benefits previously disclosed.

The wellhead extension conduit 110 is centered in the pan 100 so that the through bore 111 is normal to a plane coincident with the pan's 100 diameter. Both ends of the wellhead extension conduit 110 are fitted with industry standard connective flanges 112 for interfacing with the wellhead 10. The wellhead extension conduit 110 is connected to the convex pan floor 120 substantially midway between the extension conduit's 110 top and bottom flanges 112. The extension conduit 110 is integral with the pan floor 120, thereby eliminating the need for assembly of the pan 100 at the site with the extension conduit 110. Gaskets and O-rings are also eliminated that have previously been required for sealing the connection between the extension member and the pan floor in known designs. By eliminating the gaskets or O-rings, a potential source for leakage and cost is removed as O-rings and gaskets deteriorate over time and require replacement.

The extension conduit's top flange 112 is preferably connected to four evenly dispersed brace members 140, each of which extends in radial directions from the extension conduit's 110 centerline toward the inner face of the pan sidewall 130 to which it is connected for enhancing the structural integrity of the pan 100. At least two open loop receivers 150 are connected to the outer face of the pan sidewall 130 to facilitate installation of the pan 100 onto the wellhead 10 to be serviced.

Looking down into the pan floor 120 it can be seen that it is upwardly convex in shape, causing the center of the pan to be higher in elevation than the periphery of the pan 100. Such a shape directs liquids spilled from the wellhead 10 to the outer perimeter of the pan 100, where the liquids are drained through drain holes 160 into drainage conduit 165, and then onward to the fluid collection tank 330 for storage and removal.

The pan floor 120 incorporates an access port 121, of diameter sufficient to accept down-hole tools and their accompanying strings, between the pan 100 center and the pan sidewall 130. The access port 121 is provided with a closure or lid 122 to prevent liquids from splash-escaping out of the pan 100 through the access port 121 when not in use.

The carrying vehicle 300 is used to store the elements of the present invention for transport. The carrying vehicle 300 consists of a platform-style trailer 305, the pump 310, the air control valve 320, the fluid collection tank 330 for storing the contained liquids, and associated hardware. The carrying vehicle 300 is of sufficient payload and space to contain the pan 100, drainage conduit 165, pump 310, air control valve 320, collection tank 330, and associated hardware during transport. In one embodiment the carrying vehicle 300 accommodates up to 12,000 lbs.

In the preferred embodiment, the pump 310 is hydraulically driven by the well servicing unit's hydraulic system 315. Although the pump 310 may also be driven by an internal combustion motor or from an electrical source, these alternatives are not preferred as they present an additional fire hazard which would require the carrying vehicle 300 to be placed further away from the well and servicing unit during use. Further, the hydraulic pump 310 is able to be driven by the well servicing unit's hydraulic system 315 which includes its own hydraulic pump, which in turn is driven by the unit's power take off. This design eliminates the need for an additional power source making the system more efficient.

The hydraulic pump 310 is controlled by an operator via the pneumatic air control 320, which is preferably driven from the well servicing unit's pneumatic system 315. The control is portably mountable proximate the wellhead 10 thereby allowing the operator to operate the pump 310 as needed. The pump 310 creates a force in the drainage conduit 165 to pump liquid contained in the pan 100 to the collection tank 330 for later disposal.

A wellhead fluid collection system and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

INDUSTRIAL APPLICABILITY

The present invention finds applicability in the well drilling and well servicing industries. More specifically, the present invention relates to a fluid collection system for preventing excess fluids from the wellbore and associated down-hole tools from contacting the ground around the wellhead during well servicing.

What is claimed and desired to be secured by Letters Patent is as follows:

1. A fluid collection system for connection upon a wellhead; said system comprising:

a fluid collection pan having an upwardly open fluid reservoir, said pan adapted to be connected in-line with a wellhead conduit;

said pan having an upwardly convex floor adapted to direct collected fluids in said reservoir toward a peripheral trough, said trough formed between said floor and a surrounding side wall to said floor;

a drain positioned at said trough for accommodating withdrawal of collected fluid therefrom; and a wellhead extension conduit having a through bore configured for conveying well produced fluids from below said fluid collection pan to above said fluid reservoir, said extension conduit and said pan being unitarily configured thereby permitting on-site monolithic installation upon a wellhead.

2. A fluid collection system for connection upon a wellhead, said system comprising:

a fluid collection pan assembly having an open fluid reservoir, said pan assembly adapted to be connected in-line with a wellhead conduit; and a well head extension conduit extending through said pan assembly for conveying produced well fluids from below a floor of said pan assembly to above said floor for spillage into said reservoir, said pan assembly and said extension conduit being unitarily configured thereby avoiding on-site assembly of said well extension conduit and pan assembly and accommodating substantially leak-free installation upon a wellhead.

3. The invention as recited in claim 2; said pan assembly further comprising:

a substantially upwardly convex pan floor and a trough formed at a periphery about said convex pan floor between a portion of said pan floor and a side wall positioned adjacent thereto; and said trough forming a portion of said reservoir.

4. The invention as recited in claim 3; further comprising:

a drain positioned at said trough for withdrawing collected fluid from said reservoir, said drain being located at said periphery about said convex pan floor.

5. The invention as recited in claim 4; further comprising:

a drainage conduit fluidly connected to said drain, said drainage conduit being positioned at a clearance distance from a wellhead upon which said fluid collection system is installable.

6. The invention as recited in claim 5; further comprising:

a withdrawal pump fluidly connected to said drainage conduit, said pump adapted to be hydraulicly driven by a main hydraulic system of a well servicing rig thereby avoiding the need for a supplementary hydraulic power source at a well site.

7. The invention as recited in claim 6; further comprising:

an air control for actuating said withdrawal pump.

8. The invention as recited in claim 7; wherein said air control is adapted to be powered by a pressured air source of a well servicing rig thereby avoiding the need for a supplementary pressured air source at a well site.

9. The invention as recited in claim 6; further comprising:

a carrying vehicle adapted to transport said fluid collection system between well sites.

10. The invention as recited in claim 9; further comprising:

a fluid collection tank mounted upon said carrying vehicle, said tank adapted to receive withdrawn fluid from said drainage conduit.

11. The invention as recited in claim 2; wherein said wellhead extension conduit has two end portions, each end portion terminating in a connective flange adapted for sealed mating engagement with a wellhead conduit.

12. The invention as recited in claim 11; further comprising:

brace members connected between a side wall peripherally located about said floor and said wellhead extension conduit for rigidifying said pan assembly.

13. The invention as recited in claim 12; further comprising:

open loop receivers adapted for connection to a suspension system used in installation and removal of said pan assembly upon and from a wellhead conduit.

14. The invention as recited in claim 2; further comprising:

an access port extending through said floor of said pan assembly, said access port configured to permit well tools to be passed therethrough between above-pan and below-pan positions.

15. The invention as recited in claim 14; further comprising:

an upstanding tubular wall extending upward from said floor at a periphery of said access port, said tubular wall configured to prevent collected produced well fluids from draining from said reservoir through said access port.

16. The invention as recited in claim 15; further comprising:

a closure for capping a top portion of said tubular wall during times of non-use of said access port.

17. A fluid collection system for connection above ground upon a wellhead, said fluid collection system comprising:

a fluid collection pan assembly defining an open fluid reservoir in an upper portion thereof, said pan assembly being connectable upon said wellhead so that produced fluids pass through said pan assembly for collection in said reservoir;

a fluid withdrawal pump in fluid communication with said reservoir, said fluid withdrawal pump adapted to be hydraulically powered by a main hydraulic system of a well servicing rig, thereby avoiding the need for a supplementary hydraulic power source at a well site; and a control that is portably mountable proximate said wellhead for operating said fluid withdrawal pump.

18. The invention as recited in claim 17; further comprising:

an air control for actuating said withdrawal pump.

19. The invention as recited in claim 18; wherein said air control is adapted to be powered by a pressured air source of a well servicing rig thereby avoiding the need for a supplementary pressured air source at a well site.

* * * * *